US007185971B2

(12) United States Patent
Silverbrook

(10) Patent No.: US 7,185,971 B2
(45) **Date of Patent: *Mar. 6, 2007**

(54) THERMAL EXPANSION RELIEVING SUPPORT FOR PRINTHEAD ASSEMBLY

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/728,797

(22) Filed: Dec. 8, 2003

(65) Prior Publication Data

US 2004/0080560 A1 Apr. 29, 2004

Related U.S. Application Data

(63) Continuation-in-part of application No. 10/129,437, filed as application No. PCT/AU01/00260 on Mar. 9, 2001, now Pat. No. 6,793,323.

(30) Foreign Application Priority Data

Mar. 9, 2002 (AU) ..... PQ6111

(51) Int. Cl.
*B41J 2/14* (2006.01)
*B41J 2/015* (2006.01)

(52) U.S. Cl. ..... 347/49; 347/20

(58) Field of Classification Search ..... 347/49
See application file for complete search history.

(56) References Cited

U.S. PATENT DOCUMENTS 5,528,272 A 6/1996 Quinn et al.
5,734,394 A 3/1998 Hackleman
6,325,488 B1 * 12/2001 Beerling et al. ..... 347/42
6,652,071 B2 * 11/2003 Silverbrook ..... 347/49
6,802,594 B2 * 10/2004 Silverbrook ..... 347/49

FOREIGN PATENT DOCUMENTS

JP 11-010861 A 1/1999
JP 2000-280496 A 10/2000
WO WO 99/65691 A 12/1999

* cited by examiner

*Primary Examiner*—Stephen Meier
*Assistant Examiner*—Jannelle M. Lebron

(57) ABSTRACT

A support member (3) forming part of a printhead assembly (1) for an inkjet printer with a plurality of printhead modules (2). The support member (3) has a first component (6) and a second component (5). The first component (6) mounts the printhead assembly (1) within an inkjet printer, and the second component (5) mounts the printhead modules (2). The second component (5) has a coefficient of thermal expansion closer to that of the printhead modules (2) than the first component (6) and the first component is bonded to the second component via intermediate resilient material (7). This allows the first component (6) to be a high strength low cost material such as steel, and the second component (5) can be selected so that the overall coefficient of thermal expansion of the support member is closer to that of the printhead modules. This reduces the difference between the thermal expansion of the printhead modules (2) and the support member (3). This, in turn, makes the printing alignment of individual modules (2) with their adjacent modules is easier. By including and intermediate layer of elastomeric material (7), the greater expansion of the metal component has less effect on the other component, and therefore less effect on the alignment of the printhead modules mounted to this component.

4 Claims, 1 Drawing Sheet

THERMAL EXPANSION RELIEVING SUPPORT FOR PRINTHEAD ASSEMBLY

CROSS-REFERENCE TO RELATED APPLICATIONS

This Application is a Continuation-In-Part of U.S. Ser. No. 10/129,437 filed on May 6, 2002, now Issued Pat. No. 6,793,323, which is a national phase (371) application of PCT/AU01/00260, filed on Mar. 9, 2001.

FIELD OF THE INVENTION

The present invention relates to printers, and in particular to digital inkjet printers.

CO-PENDING APPLICATIONS

Various methods, systems and apparatus relating to the present invention are disclosed in the following co-pending applications filed by the applicant or assignee of the present invention on 24 May 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445, filed by the applicant or assignee of the present invention on 27 Nov. 2000. The disclosures of these co-pending applications are incorporated herein by cross-reference. Also incorporated by cross-reference are the disclosures of two co-filed PCT applications, PCT/AU01/00261 and PCT/AU01/00259 (deriving priority from Australian Provisional Patent Application No. PQ6110 and PQ6158). Further incorporated are the disclosures of two co-pending PCT applications filed 6 Mar. 2001, application numbers PCT/AU01/00238 and PCT/AU01/00239, which derive their priority from Australian Provisional Patent Application Nos. PQ6059 and PQ6058.

BACKGROUND OF THE INVENTION

Recently, inkjet printers have been developed which use printheads manufactured by micro-electro mechanical systems (MEMS) techniques. Such printheads have arrays of microscopic ink ejector nozzles formed in a silicon chip using MEMS manufacturing techniques. The invention will be described with particular reference to silicon printhead chips for digital inkjet printers wherein the nozzles, chambers and actuators of the chip are formed using MEMS techniques. However, it will be appreciated that this is in no way restrictive and the invention may also be used in many other applications.

Silicon printhead chips are well suited for use in page-width printers having stationary printheads. These printhead chips extend the width of a page instead of traversing back and forth across the page, thereby increasing printing speeds. The probability of a production defect in an eight inch long chip is much higher than a one inch chip. The high defect rate translates into relatively high production and operating costs.

To reduce the production and operating costs of page-width printers, the printhead may be made up of a series of separate printhead modules mounted adjacent one another, each module having its own printhead chip. To ensure that there are no gaps or overlaps in the printing produced by adjacent printhead modules it is necessary to accurately align the modules after they have been mounted to a support beam. Once aligned, the printing from each module precisely abuts the printing from adjacent modules.

Unfortunately, the alignment of the printhead modules at ambient temperature will change when the support beam expands as it heats up to the temperature it maintains during operation.

SUMMARY OF THE INVENTION

Accordingly, the present invention provides a printhead assembly for an inkjet printer, the printhead assembly comprising:

a plurality of printhead modules;

a support member with a first component and a second component, the first component adapted for mounting the printhead assembly within an inkjet printer, and the second component adapted to mount the printhead modules, the second component having a coefficient of thermal expansion closer to that of the printhead modules than the first component; wherein, the first component is bonded to the second component via intermediate resilient material; such that, Printhead assemblies according to the present invention use a composite support member so that one component can be a high strength low cost material such as steel, and another component can be selected so that the overall coefficient of thermal expansion of the support member is closer to that of the printhead modules. This reduces the difference between the thermal expansion of the printhead modules and the support member. This, in turn, makes the printing alignment of individual modules with their adjacent modules is easier. By including and intermediate layer of elastomeric material, the greater expansion of the metal component has less effect on the other component, and therefore less effect on the spacing of the printhead modules mounted to this component.

Preferably, the support member is a beam and the printhead modules include MEMS manufactured chips having at least one fiducial on each; wherein, the fiducials are used to misalign the printhead modules by a distance calculated from:

i) the difference between the coefficient of thermal expansion of the beam and the printhead chips;

ii) the spacing of the printhead chips along the beam; and, iii) the difference between the production temperature and the operating temperature.

Conveniently, the beam may have a core of silicon and an outer metal shell. In a further preferred embodiment, the elastomeric material is an elastomeric layer interposed between the silicon core and metal shell. In some forms, the outer shell may be formed from laminated layers of at least two different metals.

BRIEF DESCRIPTION OF THE DRAWING

A preferred embodiment of the invention will now be described, by way of example only, with reference to the accompanying drawing in which.

DETAILED DESCRIPTION OF PREFERRED EMBODIMENTS

Figure 1:
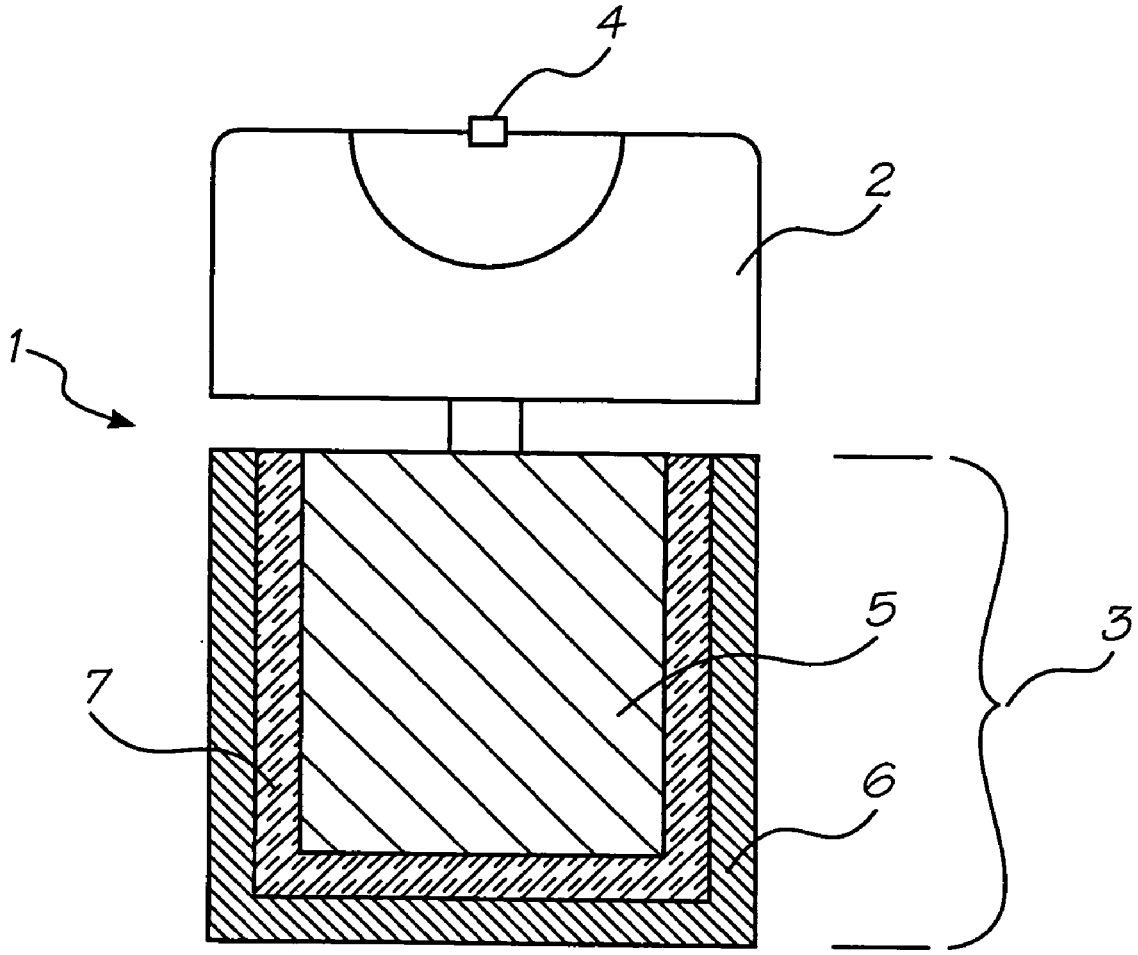
FIG. 1 shows a schematic cross section of a printhead assembly according to the present invention.

Referring to the figure the printhead assembly 1 has a plurality of printhead modules 2 mounted to a support member 3 in a printer (not shown). The printhead module includes a silicon printhead chip 4 in which the nozzles, chambers, and actuators are manufactured using MEMS techniques. Each printhead chip 4 has at least 1 fiducial (not shown) for aligning the printheads. Fiducials are reference markings placed on silicon chips and the like so that they may be accurately positioned using a microscope.

According to one embodiment of the invention, the printheads are aligned while the printer is operational and the assembly is at the printing temperature. If it is not possible to view the fiducial marks while the printer is operating, an alternative system of alignment is to misalign the printhead modules on the support beam 3 such that when the printhead assembly heats up to the operating temperature, the printheads move into alignment. This is easily achieved by adjusting the microscope by the set amount of misalignment required or simply misaligning the printhead modules by the required amount.

The required amount is calculated using the difference between the coefficients of thermal expansion of the printhead modules and the support beam, the length of each individual printhead module and the difference between ambient temperature and the operating temperature. The printer is designed to operate with acceptable module alignment within a temperature range that will encompass the vast majority of environments in which it expected to work. A typical temperature range may be 0° C. to 40° C. During operation, the operating temperature of the printhead rise a fixed amount above the ambient temperature in which the printer is operating at the time. Say this increase is 50° C., the temperature range in which the alignment of the modules must be within the acceptable limits is 50° C. to 90° C. Therefore, when misaligning the modules during production of the printhead, the production temperature should be carefully maintained at 20° C. to ensure that the alignment is within acceptable limits for the entire range of predetermined ambient temperatures (i.e. 0° C. to 40° C.).

To minimize the difference in coefficient of thermal expansion between the printhead modules and the support beam 3, the support beam has a silicon core 5 mounted within a metal channel 6. The metal channel 6 provides a strong cost effective structure for mounting within a printer while the silicon core provides the mounting points for the printhead modules and also helps to reduce the coefficient of thermal expansion of the support beam 3 as a whole. To further isolate the silicon core from the high coefficient of thermal expansion in the metal channel 6 an elastomeric layer 7 is positioned between the core 5 and the channel 6. The elastomeric layer 7 allows limited movement between the metal channel 6 and the silicon core 5. It will be appreciated that the maximum relative movement between the channel and the core will be known from the known properties of the materials used, and the known difference between the production temperature and the known operating temperature. From this, it is a simple matter to select a suitable elastomeric material and a suitable thickness of the elastomeric layer. In this way the thermal expansion of the metal channel or the core (or indeed the support beam as a whole) is not constrained but the normally high degree of thermal of the channel is significantly reduced.

The invention has been described with reference to specific embodiments. The ordinary worker in this field will readily recognize that the invention may be embodied in many other forms.

The invention claimed is:

1. A support member for supporting a plurality of inkjet printhead modules within an inkjet printer, the support member comprising:

a first component and a second component, the first component adapted for mounting in the inkjet printer, and the second component adapted to mount the printhead modules, the second component having a coefficient of thermal expansion closer to that of the printhead modules than the first component; wherein, the first component is bonded to the second component via an intermediate resilient material; such that, the first component can expand more than the second component;

wherein the support member is configured as an elongate beam, the first component of the beam is an outer metal shell, and the second component of the beam is a core of silicon within the outer metal shell.

2. A support member according to claim 1 wherein the resilient material is an elastomeric layer interposed between the silicon core and the metal shell.

3. A support member according to claim 1 wherein the outer shell is formed from laminated layers of at least two different metals.

4. A support member according to claim 1 wherein the elongate beam has a length exceeding the width of print media to be printed by the inkjet printer.

* * * * *